United States Patent [19]

Cruzan et al.

[11] Patent Number: 4,990,238

[45] Date of Patent: Feb. 5, 1991

[54] NON-CARCINOGENIC LIGHT LUBRICANTS AND A PROCESS FOR PRODUCING SAME

[75] Inventors: George Cruzan, Ringoes; Carl R. Mackerer, Pennington; Joseph J. Yang, Warren; George E. Cox, Skillman, all of N.J.

[73] Assignee: Mobil Oil Corporation, Fairfax, Va.

[21] Appl. No.: 459,234

[22] Filed: Dec. 29, 1989

[51] Int. Cl.[5] ..... C10G 71/00

[52] U.S. Cl. ..... 208/18; 208/2; 208/19

[58] Field of Search ..... 208/2, 19

[56] References Cited

U.S. PATENT DOCUMENTS

| | | | |
|---|---|---|---|
| 2,310,194 | 2/1943 | Harvey, Jr. | 208/2 |
| 2,352,213 | 6/1944 | Lieber et al. | 208/19 |
| 3,011,974 | 12/1961 | Henke | 208/19 |
| 3,250,711 | 5/1966 | Early | 208/19 |
| 3,506,565 | 4/1970 | White et al. | 208/19 |
| 3,791,959 | 2/1974 | Mills et al. | 208/19 |
| 4,082,866 | 4/1978 | Link | 208/19 |
| 4,157,294 | 6/1979 | Iwao et al. | 208/19 |
| 4,213,845 | 7/1980 | Masada | 208/19 |
| 4,719,002 | 1/1988 | Mayer et al. | 208/85 |
| 4,891,126 | 1/1990 | Mochida et al. | 208/44 |
| 4,894,142 | 1/1990 | Steigleder | 208/143 |

OTHER PUBLICATIONS

Horton and Denman, "Carcinogenesis of the Skin. A Re-Examination of Methods for the Quantitative Measurement of the Potencies of Complex Materials", 15 Cancer Research 701 (1955).

Horton, Denman and Trosset, "Carcinogenesis of the Skin. II. The Accelerating Properties of Aliphatic and Related Hydrocarbons", 17 Cancer Research 758 (1957).

Gilbert and Sice, "Dose-Response Relationship of Tumor Promoting Agent", 2 Toxicology and Applied Pharmacology 392 (1960).

Saffiotti and Shubik, "Studies on Promoting Action in Skin Carcinogenesis", 10 National Cancer Institute Monograph 489, (1963).

Sice, "Tumor-Promoting Activity of N$_8^3$Alkanes and 1-Alkanols", a Toxicology and Applied Pharmacology 70 (1966).

Baxter and Miller, "Mechanism of Mouse Skin Tumor Promotion by N-Dodecane", 8 Carcinogenesis 1787 (1987).

Gerhart, Hatoum, Halder, Warne and Schmitt, "Tumor Initiation and Promoting Effects of Petroleum Streams in Mouse Skin", 11 Fundamental and Applied Toxicology 76, (1988).

*Primary Examiner*—Helane E. Myers

*Attorney, Agent, or Firm*—Fairfax, VA 22037; A. J. McKillop; C. J. Speciale

[57] ABSTRACT

A substantially non-carcinogenic light lubricant and a process for its production. The process comprises the step of blending an effective amount of a substantially non-tumorigenic vacuum distilled hydrocarbon oil of luricating viscosity with a tumorigenic atmospheric distilled light hydrocarbon oil, the tumorigenic light hydrocarbon oil having an initial boiling point of at least 250° F., wherein the resultant blend is substantially non-carcinogenic and of lubricating viscosity.

20 Claims, No Drawings

NON-CARCINOGENIC LIGHT LUBRICANTS AND A PROCESS FOR PRODUCING SAME

FIELD OF THE INVENTION

The present invention relates to useful light lubricating oils and to a process for their preparation. More particularly, this invention is directed to non-carcinogenic light lubricating oils.

BACKGROUND OF THE INVENTION

In the refining of lubricant base stocks, a series of generally subtractive processes is employed to remove undesirable components from the process feedstock. The most important of these processes include atmospheric and vacuum distillation, deasphalting, solvent extraction, and dewaxing. These processes are basically physical separation processes in the sense that if all the separated fractions were recombined the crude oil would be reconstituted.

Refineries do not manufacture a single lube base stock but rather process several distillate fractions and a vacuum residuum fraction. Atmospheric distillation of crude oil produces several fractions, depending upon the type of crude available and the operations of the refinery. Two fractions are generally considered middle distillates. These are straight run kerosine, with a boiling range of 345°-510° F. and light gas oil, with a boiling range of approximately 510°-700° F. Products derived from these fractions include kerosine, jet fuel, diesel fuel, home heating oil and marine fuel. The lighter middle distillates are also used as specialty lubricants, such as mineral seal oils, spindle oils, honing oils and cold-rolling oils for aluminum, steel, copper and the like.

Generally, at least three vacuum distillate fractions differing in boiling range and the residuum may be refined. These four fractions have acquired various names in the refining art, the most-volatile vacuum distillate fraction often being referred to as the "light neutral" fraction or oil. The other vacuum distillates are known as "intermediate neutral" and "heavy neutral" oils. The vacuum residuum, after deasphalting, solvent extraction and dewaxing, is commonly referred to as "bright stock." Thus, the manufacture of lubricant base stocks involves a process for producing a slate of base stocks. Additionally, each subtractive step produces a byproduct which may be processed further or sold to an industry which has developed a use for the byproduct.

As mentioned, conventional processing of crude petroleum oil to recover fractions suitable for upgrading in various refinery processing operations employs multi-stage distillation. Crude oil is first distilled or fractionated in an atmospheric distillation tower, with residual material from the bottom of the distillation tower being further separated in a vacuum distillation tower. In this combination operation, gas and gasoline generally are recovered as overhead products of the atmospheric distillation tower, heavy naphtha, kerosene and gas oils are taken off as distillate side streams and the residual material is recovered from the bottom of the tower as reduced crude. Steam may be introduced to the bottom of the tower and various side strippers used to remove light material from withdrawn heavier liquid products. The residual bottoms fraction or reduced crude is usually charged to a vacuum distillation tower. The vacuum distillation step in lube refining provides one or more raw stocks within the boiling range of about 550°

F. to 1050° F., as well as the vacuum residuum byproduct. Often the vacuum charge is heated by a furnace means in order to vaporize a portion of the charge. The preheated charge normally enters a lower portion of the vacuum tower and the vapors therefrom rise through the tower where they are cooled in selected stages producing successively lighter liquids which are separately withdrawn as the sidestream raw stock products.

Following vacuum distillation, each raw stock is extracted with a solvent, e.g. furfural, phenol or chlorex, which is selective for aromatic hydrocarbons, removing undersirable components. The vacuum residuum usually requires an additional step, typically propane deasphalting, to remove asphaltic material prior to solvent extraction. The products produced for further processing into base stocks are known as raffinates. The raffinate from solvent refining is thereafter dewaxed by admixing with a solvent such as a blend of methyl ethyl ketone and toluene, for example and then processed into finished base stocks.

The solvent extraction step separates hydrocarbon mixtures into two phases; the previously described raffinate phase which contains substances of relatively high hydrogen to carbon ratio, often called paraffinic type materials, and an extract phase which contains substances of relatively low hydrogen to carbon ratio often called aromatic type materials. Solvent extraction is possible because different liquid compounds have different solution affinities for each other and some combinations are completely miscible while other combinations are almost immiscible. The ability to distinguish between high hydrogen to carbon paraffinic type and low hydrogen to carbon aromatic type materials is termed selectivity. The more finely this distinguishing can be done, the higher the selectivity of the solvent. Furfural is typical of a suitable solvent extraction agent. Its miscibility characteristics and physical properties permit use with both highly aromatic and highly paraffinic oils of wide boiling range. Diesel fuels and light and heavy lubricating stocks are often refined with furfural.

Some chemical compounds have been shown to cause skin cancer in humans and laboratory animals following skin contact. In recent years, concerns have arisen regarding the potential hazards associated with the use of various lubricating oils, middle distillates and petroleum products, in general. Previous studies of the higher boiling fractions recovered from vacuum distillation and processed to formulate engine oils and other lubricants have established a fairly consistent pattern of the types of petroleum-derived materials which cause tumors in laboratory animals. Extensively treated oils, such as those treated by solvent refining and severe hydroprocessing are known to have only trace amounts of polycyclic aromatic hydrocarbons (PAH). As such, these oils are generally not tumorigenic; while oils having high PAH levels, especially those compounds of four or more rings, are.

The middle distillates used as specialty oils possess the potential for significant human exposure due to the nature of their industrial applications. Because such straight-run middle distillates boil below 700° F. and typically contain only small levels of PAH compounds, they would not be expected to cause tumors in tests conducted in laboratory animals. However, experiments using laboratory animals have shown this to not be the case.

An indication of tumorigenicity is the time until tumors are developed and observed. Materials that induce skin tumors in a large proportion of laboratory mice typically have a relatively short latency period, and conversely, when the latency period is long few mice develop tumors. It has been found that exposure to middle distillate-based lubricants, however, does not follow this trend. Although several investigations have either not used laboratory animals or long-term topical administration and, as such, have failed to identify the dermal carcinogenicity of kerosine- and middle distillate-based lubricants, one study has shown that a large proportion of mice developed tumors when exposed to such materials over an extended period of time, finding a mean latency period of 79 weeks. (See: G. R. Blackburn, R. A. Deitch, C. A. Schreiner, M. A. Mehlman and C. R. Mackerer, "Predicting Carcinogenicity of Petroleum Fractions Using a Modified Salmonella Mutagenicity Assay", *Cell Biology and Toxicology*, 2:63–84, 1986). Since industry workers are frequently exposed to middle distillate-based lubricants both continuously and over long periods of time, the finding that such materials can cause tumors is of much concern.

Therefore, what is needed is a non-carcinogenic light industrial lubricant and a process for the production of such a lubricant.

SUMMARY OF THE INVENTION

In accordance with the present invention, there is provided a substantially non-carcinogenic light lubricant, as well as a process for its production. The process for the production of the non-carcinogenic light industrial lubricant comprises the step of blending an effective amount of a substantially non-tumorigenic vacuum distilled hydrocarbon oil of lubricating viscosity with a tumorigenic atmospheric distilled light hydrocarbon oil, the tumorigenic light hydrocarbon oil having an initial boiling point of at least 250° F., wherein the resultant blend is substantially non-carcinogenic and of lubricating viscosity.

It is, therefore, an object of this invention to provide a substantially non-carcinogenic light industrial lubricant.

It is another object of this invention to provide a process for making a substantially non-carcinogenic light industrial lubricant.

It is a further object of this invention to provide a light industrial lubricant which does not cause skin irritation.

Other objects, aspects and the several advantages of the present invention will become apparent to those skilled in the art upon a reading of the specification and the claims appended thereto.

DETAILED DESCRIPTION OF THE INVENTION

To produce the non-carcinogenic light lubricants of the present invention, process streams from conventional, well-known refining processes can be utilized. Light lubricant process streams most benefitted by the practice of the present invention are those having a significant level of tumorigenicity, selected from hydrocarbon materials boiling within the range of from about 250° to about 700° F. Such hydrocarbon materials are known to have a significant proportion of $C_{10}$ through $C_{20}$ hydrocarbons and may be produced by atmospheric distillation alone, or in conjunction with other conventional processes, including gasoline upgrading processes which produce, as a byproduct, a middle distillate boiling range material. An example of such a process is alkylation, where a heavy (non-gasoline) alkylate is generally produced as a byproduct. Besides heavy alkylate, examples of other useful hydrocarbon process streams include the kerosine and light gas oil cuts often used in specialty industrial lubricants. Streams produced by atmospheric distillation followed by vacuum distillation, either alone, or followed by other conventional lubricant refining steps, also fall within the range of materials envisioned as being benefitted by the process of the present invention. However, it is to be understood that such hydrocarbon streams are to fall within the above-cited boiling range, have a significant amount of $C_{10}$ through $C_{20}$ hydrocarbons and exhibit a significant level of tumorigenicity if tested in laboratory animals using standard evaluation procedures. Such vacuum distilled materials would include base stocks used as specialty oils and spindle oils, exhibiting viscosities up to and including about 40 SUS.

The present invention is predicated on the discovery that the blending of an effective amount of a heavier, higher boiling range hydrocarbon material into a tumorigenic middle distillate or light vacuum distilled lubricant will serve to significantly reduce the tumorigenicity of the resultant light lubricant oil to a point at which it is substantially non-carcinogenic. Such heavier, higher boiling range hydrocarbon materials are those which are produced by vacuum distilling an atomospheric reduced crude and include materials boiling within the range of greater than about 600° through 1000° F. and higher. Those heavier hydrocarbon streams finding utility in the practice of the present invention are those having a significant level of $C_{21}$ and higher hydrocarbons and include those streams known to those skilled in the lubricant refining art as light neutral oil, intermediate neutral oil, heavy neutral oil and bright stock. Such streams further processed by solvent treating, hydroprocessing and the like are to be considered process streams envisioned as being within the scope of the present invention. Preferred in the practice of the present invention are those lubricating oil base stocks which contain greater than 50 percent $C_{21}$ and above hydrocarbons, with those comprising virtually 100 percent $C_{21}$ and above hydrocarbons and subjected to solvent treating or severe hydroprocessing to reduce the level of aromatic materials being particularly preferred.

As indicated, the amount of heavier, higher boiling range material to be utilized in the light lubricant blends of the present invention is an amount effective to significantly reduce tumorigenicity to a level wherein the resultant blend is substantially non-carcinogenic and of lubricating viscosity. Although the actual amount of higher boiling range material effective to significantly reduce tumorigenicity to a level which renders the resultant blend substantially non-carcinogenic will vary depending upon the characteristics of the tumorigenic light oil, an amount found to be effective is one in which the final light industrial lubricant blend comprises at least about 20 percent of $C_{21}$ and above hydrocarbons. As those skilled in the art will readily recognize, the upper limit of such heavier material will be dictated by the particular viscosity specification to be met by the resultant blended product. Moreover, to achieve the viscosity specification for some light lubricant products, it may be necessary to begin with a somewhat lighter base material in order to permit the incorporation of the effective amount of heavy, higher boiling range material into the light lubricant.

The following examples demonstrate the unexpected results obtained by the process of the present invention. The invention is illustrated by the following non-limiting examples.

EXAMPLE 1

Characteristics of the base components and light lubricant blend utilized in this example were as follows:

TABLE 1

| Test Fluid | Description | Boiling Range (°F.) | Viscosity (SUS @ 100° F.) | Hydrocarbon Characterization (Estimated) |
|---|---|---|---|---|
| A | Light Gas Oil | 422–477 | 33 | $C_{16}$ and below |
| B[1] | Paraffinic Bright Stock | 892–1000 | N.D.[2] | $C_{25}$ and above |
| C | Blend: 67% A to 33% B | 422–1000 | N.D.[3] | $C_{16}$–$C_{25}$ and above |

[1]Solvent treated base oil.
[2]Not determined. Viscosity at 212° F. found to be 130 SUS.
[3]Not determined.

Test Fluid A is a hydrofinished narrow cut middle distillate light gas oil which serves industry as a lubricant for the cold rolling of aluminum. It has a boiling range of 422°–477° F. and is composed of less than 10% aromatic compounds of one to two rings; the remainder of the hydrocarbon compounds are straight-chain, branched-chain or cycloparaffins. Test Fluid B is a furfural treated bright stock base oil of the type typically used in the blending of engine oils for automotive use and the like.

As is well known to those skilled in the art, mice have been shown to be an effective model for predicting a chemical compound's potential to induce skin cancer in man. To evaluate the relative carcinogenic and tumorigenic propensities of the above-described lubricating fluids, male C3H mice were obtained from the Jackson Laboratory of Bar Harbor, ME and acclimated to the test facility used to conduct the subject experiment. Fifty healthy mice, about eight to nine weeks old, were assigned to each treatment group. One group of 50 served as untreated controls, another control group of fifty were treated with 50 μl of 0.05% benzo(a)pyrene in toluene twice per week.

The mice were housed in groups of five in stainless steel cages having wire mesh fronts and bottoms. Their hair was shaved from their backs once every two weeks using electric clippers. Test Fluid A was applied twice per week for 80 weeks or until a skin tumor was observed. Using a calibrated pipette, 50 μl was applied, per application, to the back of each mouse within the group selected to evaluate this material. Test Fluid C, the 67%/33% blend of Test Fluids A and B, was applied three times per week, 50 μl per application; thus delivering the same amount of Test Fluid A to each mouse in the two test groups in a given week. The application of Test Fluid C to the mice in that test group was also carried out for a period of eighty weeks, or until a skin tumor was observed. The mice were observed for an additional 35 weeks following the termination of substance applications.

The animals were evaluated for tumors at the site of application. The examination included weekly visual inspection of the animals during the biophase and microscopic examination of the treated skin. Animals were killed for microscopic examination if a tumor grew large enough and became ulcerated and/or necrotic.

A summary of test results of the evaluation are presented in Table 2 for the mice treated with Test Fluid A, and in Table 3 for the mice treated with the Test Fluid C blend. As can be seen by comparing the results presented in Tables 2 and 3, the mice treated with Lubricant A yielded far more tumors than the mice treated with the 67%/33% blend of Test Fluids A and B. This reduction in carcinogenic activity results from an unknown mechanism, possibly involving competing biomolecular interactions within the skin, but not from simple dilution since each mouse was treated with the identical amount of Test Fluid A, as indicated above. The total number of mice with tumors for the Test Fluid A-treated population was 40 at 104 weeks, 39 of which had been found to have malignant tumors. At 104 weeks, 4 mice in the Test Fluid C-treated population had skin tumors, 3 of which were advanced and one benign. The median latency period was 76 weeks for the Test Fluid A-treated population and 100 weeks for the Test Fluid C-treated population.

Skin irritation was persistent throughout the treatment period for the Test Fluid A-treated mice. Severe skin effects characterized by thickened and stiffened skin with cracks and fissures were observed on most animals. The mice treated with Lubricant C were observed to exhibit only mild skin flaking. These results provide strong evidence that skin irritation may be the primary factor in the development of skin tumors from exposure to light industrial lubricants, since both skin irritation and the incidence of tumors was greatly reduced by the blending of an effective amount of a non-tumorigenic solvent treated hydrocarbon oil of lubricating viscosity with a tumorigenic atmospheric distilled light hydrocarbon oil.

TABLE 2

| RESULTS OF FLUID A EVALUATION | |
|---|---|
| Number of Mice Tested | 50 |
| Number of Mice Surviving 104 Weeks | 2 |
| Number of Mice Dying Without Skin Tumor | 10 |
| Total Number of Mice With Skin Tumor | 40[1] |
| Number of Mice With Grossly Observed Skin Tumor | 37 |
| Number of Mice With Benign Skin Tumor | 1 |
| Number of mice With Advanced Skin Tumor | 39 |
| Median Time (Weeks) to Appearance of Skin Tumor | 76 |

[1]Two tumors were not observed during in-life period, but were found by microscopic examination.

TABLE 3

| RESULTS OF FLUID C EVALUATION | |
|---|---|
| Number of Mice Tested | 50 |
| Number of Mice Surviving 104 Weeks | 10 |
| Number of Mice Dying Without Skin Tumor | 39 |
| Total Number of Mice With Skin Tumor | 4 |
| Number of Mice With Grossly Observed Skin Tumor | 4 |
| Number of Mice With Benign Skin Tumor | 1 |
| Number of Mice With Advanced Skin Tumor | 3 |

TABLE 3-continued

| RESULTS OF FLUID C EVALUATION | |
|---|---|
| Median Time (Weeks) to Appearance of Skin Tumor | 100 |

EXAMPLE 2

Characteristics of the base components and blend utilized in the following example were as follows:

TABLE 4

| Test Fluid | Description | Boiling Range (°F.) | Viscosity (SUS @ 100° F.) | Hydrocarbon Characterization (Estimated) |
|---|---|---|---|---|
| D | Heavy Alkylate | 285–360 | N.D.[3] | $C_9$ through $C_{12}$ |
| E[1] | Paraffinic Light Neutral | 620–735 | 60 | $C_{19}$–$C_{25}$[2] |
| F | Blend: 60% D to 40% E | 285–735 | N.D.[3] | $C_9$ through $C_{25}$ |

[1]Solvent treated base oil.
[2]Base oil comprised about 50% $C_{21}$ and above hydrocarbons.
[3]Not determined.

The heavy alkylate material of Test Fluid D, a by-product of high octane blend stock alkylation, is typically utilized in the middle-distillate diesel fuel/home heating oil refinery pool and finds additional utility on a smaller scale in the blending of specialty oils. Heavy alkylate typically boils within the range 285°–360° F. and is composed of primarily $C_9$ through $C_{12}$ hydrocarbons. The paraffinic light neutral oil of Test Fluid E is a 60" SUS furfural-treated mineral oil which boils within the range 620°–735° F. and is composed of primarily $C_{19}$ through $C_{25}$ hydrocarbons. Test Fluid E was estimated to contain approximately 50% $C_{21}$ and above hydrocarbons. When blended in accordance with the ratios of Test Fluid F, the resultant product finds utility as a low aquatic toxicity drilling mud oil which can also serve as a fuel source on drilling platforms.

Tests using C3H laboratory mice were conducted to determine the tumorigenicity of the Sample F relative to an untreated control group and another group treated with 0.05% benzo-a-pyrene. Tests were performed in substantially the manner as those conducted and described in Example 1.

Results are summarized in Table 5, below.

TABLE 5

| RESULTS OF FLUID F EVALUATION | |
|---|---|
| Number of Mice Tested | 50 |
| Number of Mice Surviving 104 Weeks | 10 |
| Number of Mice Dying Without Skin Tumor | 40 |
| Total Number of Mice With Skin Tumor | 4 |
| Number of Mice With Grossly Observed Skin Tumor | 1 |
| Number of Mice With Benign Skin Tumor | 3 |
| Number of Mice With Advanced Skin Tumor | 1 |
| Median Time (Weeks) to Appearance of Skin Tumor | 104 |

As indicated, skin tumors were observed at the application site in four mice; with three of these being benign tumors (papilloma or keratoacanthoma) and one a malignant tumor. Only one of these tumors was observable without the aid of a microscope. The tumors occurred late in the animals' lives; the first tumor being found during test week 98. The median latency was found to be 111 weeks. By comparison, over 80% of the mice treated with 0.05 benzo-a-pyrene developed skin tumors with a mediam latency period of 43 weeks.

Although the heavy alkylate material used to formulate the blend of Sample F is known to be a prolific skin irritant, and as such would likewise be expected to cause skin tumors over a long period of repeated exposure, the blending of an effective amount of the paraffinic light neutral oil into the heavy alkylate was found to greatly reduce the tumorigenicity of the resultant blend to the point where it could be characterized as no more than a very weak tumorigen and substantially non-carcinogenic.

Although the present invention has been described with preferred embodiments, it is to be understood that modifications and variations may be made without departing from the spirit and scope of this invention, as those skilled in the art will readily understand. Such modifications and variations are considered to be within the purview and scope of the appended claims.

What is claimed is:

1. A process for the production of a substantially non-carcinogenic light lubricant from a tumorigenic atmospheric distilled light hydrocarbon oil, comprising the step of blending an effective amount of a substantially non-tumorigenic vacuum distilled hydrocarbon oil of lubricating viscosity having a significant level of $C_{21}$ and higher hydrocarbons with the tumorigenic atmospheric distilled light hydrocarbon oil, the tumorigenic light hydrocarbon oil boiling within the range of from about 250° F. to about 700° F., wherein the resultant blend is of lubricating viscosity and is substantially non-carcinogenic as indicated by a long-term topical administration test conducted on a mice population in which less than 10% of the population develop skin tumors.

2. The process of claim 1, wherein the substantially non-tumorigenic vacuum distilled oil is selected from the group consisting of light mineral oil, intermediate neutral oil and bright stock.

3. The process of claim 1, wherein the vacuum distilled oil is further processed to reduce aromatic content.

4. The process of claim 3, wherein the aromatic content of the vacuum distilled oil is reduced by severe hydroprocessing.

5. The process of claim 3, wherein the aromatic content of the vacuum distilled oil is reduced by solvent treating.

6. The process of claim 3, wherein the solvent employed to treat the vacuum distilled oil is furfural.

7. The process of claim 3, wherein the vacuum distilled oil is comprised of at least about 50% $C_{21}$ or above hydrocarbon molecules.

8. The process of claim 6, wherein the vacuum distilled oil is comprised of at least about 75% $C_{21}$ or above hydrocarbon molecules.

9. The process of claim 1, wherein the tumorigenic atmospheric distilled light hydrocarbon oil is selected from the group consisting of heavy alkylate and middle distillates.

10. The process of claim 1, wherein the substantially non-carcinogenic light lubricant is comprised of at least about 20% $C_{21}$ or above hydrocarbon molecules.

11. A substantially non-carcinogenic light lubricant produced in accordance with claim 1.

12. A substantially non-carcinogenic light lubricant produced in accordance with claim 2.

13. A substantially non-carcinogenic light lubricant produced in accordance with claim 3.

14. A substantially non-carcinogenic light lubricant produced in accordance with claim 4.

15. A substantially non-carcinogenic light lubricant produced in accordance with claim 5.

16. A substantially non-carcinogenic light lubricant produced in accordance with claim 6.

17. A substantially non-carcinogenic light lubricant produced in accordance with claim 7.

18. A substantially non-carcinogenic light lubricant produced in accordance with claim 8.

19. A substantially non-carcinogenic light lubricant produced in accordance with claim 9.

20. A substantially non-carcinogenic light lubricant produced in accordance with claim 10.

* * * * *